United States Patent [19]

Kanfer

[11] Patent Number: 4,506,784

[45] Date of Patent: Mar. 26, 1985

[54] MULTIPLE-USE CONTAINER

[76] Inventor: Joseph S. Kanfer, 2825 N. Walnut Ridge, Akron, Ohio 44313

[21] Appl. No.: 581,911

[22] Filed: Feb. 21, 1984

[51] Int. Cl.[3] ..... B65D 83/00; B65D 47/36

[52] U.S. Cl. ..... 206/77.1; 220/93; 220/276; 222/327

[58] Field of Search ..... 206/77.1; 220/276, 93; 222/327

[56] References Cited

U.S. PATENT DOCUMENTS

| | | | |
|---|---|---|---|
| 983,437 | 2/1911 | Gray | 220/93 |
| 1,636,407 | 7/1927 | Brommer . | |
| 1,941,139 | 12/1933 | Creveling | 221/47.3 |
| 2,022,706 | 12/1935 | Clark | 220/93 |
| 2,025,232 | 12/1935 | Dodge | 220/93 |
| 2,090,111 | 8/1937 | Creveling | 221/47.4 |
| 2,131,487 | 9/1938 | Tear | 221/47.3 |
| 2,252,115 | 8/1941 | Brue | 220/93 |
| 2,815,994 | 12/1957 | Lippman | 309/23 |
| 2,941,699 | 6/1960 | Schmidt | 222/327 |
| 3,161,325 | 12/1964 | Hinkel | 222/80 |
| 3,273,741 | 9/1966 | Faunce | 220/26 |
| 4,256,241 | 3/1981 | Mesic | 222/85 |
| 4,437,589 | 3/1984 | Potter | 220/93 |

*Primary Examiner*—William T. Dixson, Jr.

*Attorney, Agent, or Firm*—Reese Taylor

[57] ABSTRACT

A multiple-use container for viscous materials, such as soap, for example, includes a cylindrical body capable of receiving the soap, one end of which receives a removable lid and the other end of which has an integral bottom panel capable of serving as a conventional bottom for the container or, upon modification, as a push plate or dispensing member for the material. The bottom panel is joined to the walls of the cylindrical body by an annular, reduced thickness area or score line spaced slightly inwardly from the inner wall surface of the body. A second, concentric, reduced thickness area or score line, disposed approximately at the midpoint of the bottom panel, defines a removable access disc. The multiple-use container is capable of being used either as a dip can or as a self dispensing can. In the first mode, removal of the lid permits access to the interior so that the material may be dipped out. In the second mode, inversion of the container, so that the lid effectively becomes the bottom, followed by severing the access disc along its score line and the bottom panel along its score line permits the bottom panel to serve as a dispensing member whereby depressing it against the material will force some of the material through the access opening and render it available for use by the user.

1 Claim, 5 Drawing Figures

MULTIPLE-USE CONTAINER

FIELD OF THE INVENTION

This invention relates, in general, to containers for viscous material such as soap and relates, in particular, to a container designed for multiple-use either as a dip can or as a self dispensing can or container.

DESCRIPTION OF THE PRIOR ART

In the prior art, many viscous materials, such as, for example, heavy duty hand cleaner, soap, or other such material, are sold in plastic containers which are generally cylindrical in nature and include a cylindrical body, a removable top lid, and an integral bottom wall.

The conventional manner of obtaining access to the material is to simply rest the container on a supporting surface and remove the removable lid, following which one may dip into the material as desired. This is essentially what is referred to in this application as a "dip can".

While using such a container in this manner is, of course, fully practical for most purposes, it has also been found in the prior art that it is sometimes desirable to make the container into a "self dispensing" container. This is normally accomplished by adding to the combination of cylindrical body, integral bottom wall, and removable lid, a push plate or dispensing member which is inserted inside the cylinder so as to rest on top of the material and beneath the removable lid. Thus, when the lid is removed, the push plate or dispensing member can be depressed and soap will be forced through a central access opening therein.

Again, this type of container is fully utilizable and has found wide acceptance.

However, the second type of container just mentioned has certain disadvantages. Primarily the disadvantages are two-fold. First, an entirely separate piece, i.e., the push plate or dispensing member, must be manufactured, thereby obviously increasing the material and manufacturing cost of the container. Essentially this results in a three part container having a cylindrical body and a unitary bottom wall, a push plate or dispensing member, and a removable lid.

Second, manufacture or assembly of a container of this nature requires an extra assembly step which is expensive from the standpoint of the labor involved. Specifically, it is necessary to manufacture the cylindrical body and integral bottom wall, fill the container with the material, insert the push plate or dispensing member, and then secure the removable lid. Since containers of this type are commonly mass produced in significant numbers, it can be appreciated that an added step in the manufacturing process, multiplied over the total number of containers being utilized by any given manufacturer, can be very significant.

SUMMARY OF THE INVENTION

It is, therefore, an object of the present invention to produce a multiple-use container capable of being utilized in both the conventional dip can and self dispensing modes but with a significant reduction in material cost, manufacturing cost, and assembly time.

It has been found that this object can be achieved by producing a multiple-use container comprising essentially a cylindrical body with an integral bottom panel on one end and closed off at the other end by a removable lid. It has been found that the multiple-use objects of this invention can be achieved by providing that the integral bottom panel is detachably joined to the wall of the cylindrical body by an annular score line or reduced thickness area spaced slightly inwardly from the wall of the body and that an access opening can also be defined by a concentric score line located substantially at the midpoint of the bottom panel. In this fashion, the container is selectively suitable for use either as a dip can or as a self dispensing container depending upon whether the bottom panel is employed for its conventional purpose or severed and used as a push plate with the container is an inverted position.

Thus, while the self dispensing capability is presented, the total number of components and, therefore, the total amount of material employed, is not increased nor is the time of assembly since it is only necessary to mold the body and the bottom panel, fill the container, and apply the lid.

Accordingly, production of an improved multiple-use container of the type above-described becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENT

Figure 1:
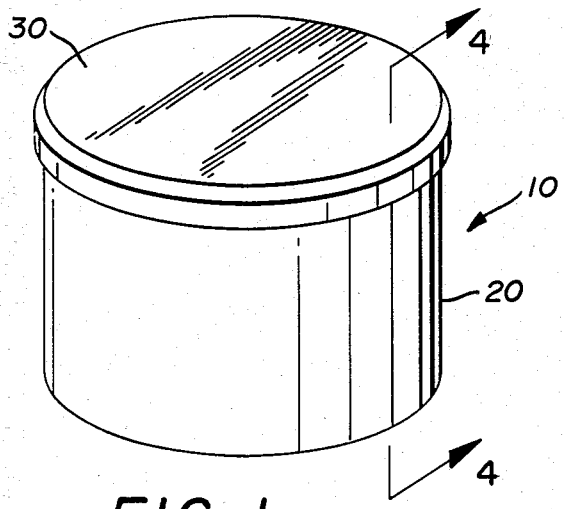
FIG. 1 is a perspective view of the improved container with the lid applied.
Figure 2:
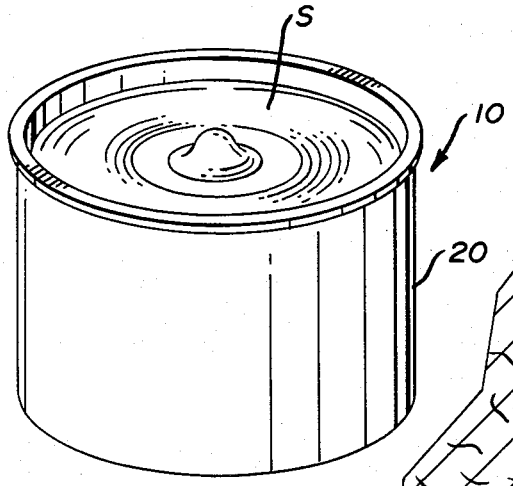
FIG. 2 is a perspective view of the improved container with the removable lid removed.
Figure 4:
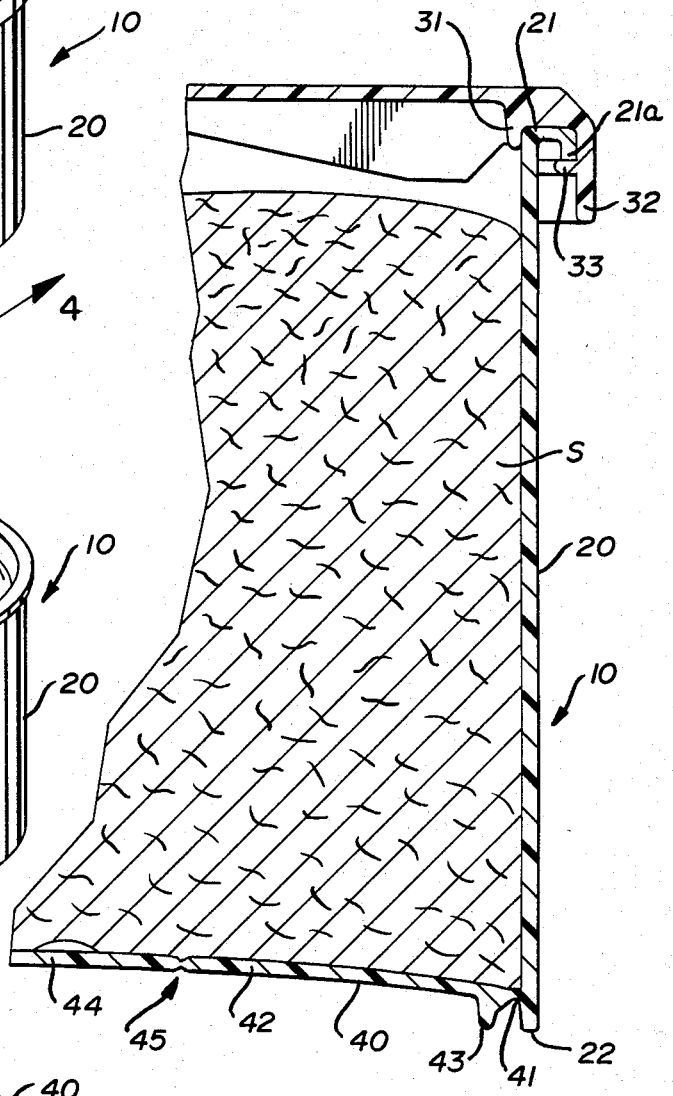
FIG. 4 is a sectional view taken along the line 4—4 of FIG. 1.

Referring to FIGS. 1, 2, and 4 of the drawings, it will be noted that the improved container, generally indicated by the numeral 10, includes three main elements although two of them are, in fact, integral. Specifically, the cylindrical body 20 receives on one end a removable lid 30 and has its other end closed by an integral bottom panel 40. The material S is deposited and received, of course, within the body 20, resting on the integral bottom panel 40 as illustrated in FIG. 4.

The body 20 has opposed top and bottom edges 21 and 22, with the top edge terminating in a conventional, radially and axially extending locking flange 21*a*.

The removable lid 30 has an annulary locating rib 31 and a cooperating flange 32 with a locking member 33 and radially extending reinforcing ribs 34. This makes it possible to snap the lid 30 onto the top wall 21, engaging the flange 21*a* for security. On the other hand, the container material, which would normally be plastic or some similar material, is flexible enough so that the lid 30 can be snapped off when desired.

Figure 5:
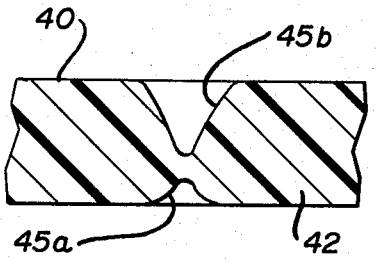
FIG. 5 is an enlarged sectional view of the end panel.

Referring to FIGS. 4 and 5, the bottom panel 40 is molded integrally with the cylindrical body 20 adjacent its bottom edge 22 and includes a main body portion 42 and a peripheral score line or reduced thickness area 41. The score line 41 is spaced slightly radially inwardly from the inner wall of the body 20 and axially inwardly from the bottom edge 22 thereof so that, when the bottom panel 40 is severed from the body 20, the dispensing member formed thereby is of sufficient size so as to enable it to freely move within the body 20 against the material S.

Figure 3:
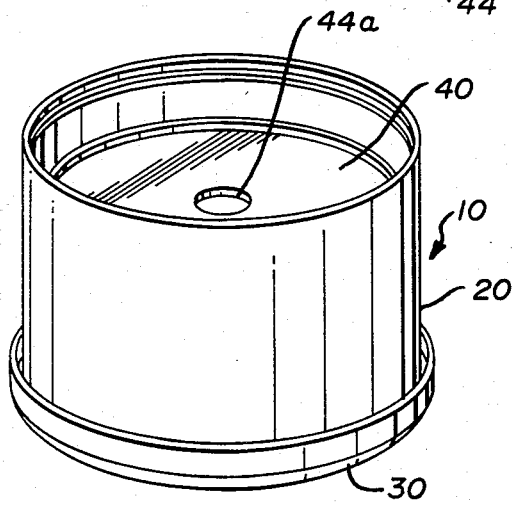
FIG. 3 is a perspective view of the improved container inverted and with the bottom panel severed and the access disc severed.

The bottom panel 40 also has a reinforcing rib 43 and a concentric score line 45 disposed near its midpoint so as to define an access disc 44 which, when removed, permits access of the soap to the exterior. This disc 44 is illustrated in FIG. 4 of the drawings and the opening formed by its removal is illustrated in FIG. 3 at 44*a*.

It will also be noted that the reduced thickness area 45 is illustrated as being formed by molding a first groove 45*a* extending from the exterior and an opposed groove 45*b* extending from the interior. This reduces the thickness sufficiently to permit easy removal of disc 44. It has been found that reducing the thickness in this way facilitates the molding operation although the desired operational result, i.e., easy removal of the disc, can be achieved by removing the desired amount of the material solely from the exterior if desired.

In use or operation of the improved container, as noted above, the container is operable in two modes, i.e., as a dip can and as a self dispensing can.

Referring to FIG. 2 of the drawings, the dip can mode can be seen. Here, it is simply necessary to rest the bottom edge 22 on a supporting surface and remove the lid 30 by snapping it off the locking flange 21*a*, following which the material S is readily accessible to be dipped out of the interior of the container by hand or with some sort of utensil.

Referring to FIG. 3 for an illustration of the self dispensing mode, it will be seen that the container is inverted so that the lid 30 serves as the support for the container. Following this, it is simply necessary to cut along the score line 45 to remove the access disc 44 and provide the access opening 44*a*. It is then necessary to cut along the score line 41, thereby freeing the bottom panel 40 from the body 20 of the container. As can be seen in FIG. 3, pushing down on the bottom panel 40, which has now been transformed into a push plate or material dispensing member, forces the material S up through the access opening 42*a* to provide a self dispensing container.

It is believed apparent that, in the manufacturing process, the body 20 and the bottom panel 40 will be molded as an integral unit. The only other molding operation required would be the removable lid 30. Therefore, it is believed equally apparent that one of the usual three pieces required for a self dispensing container has been eliminated. The saving in material cost is substantial, particularly when large volumes of containers are being manufactured. The result is a container having the capability of either a dip can or self dispensing can while having the material requirements of the dip can only.

In the assembly operation, it is merely necessary to fill the container with the material S and apply the removable lid 30. Here, again, it is believed apparent that one step in the manufacturing operation has been eliminated in that it is not necessary to insert a separate push plate or dispensing member on top of the material S prior to affixing the removable lid 30 as is normally the case with a self dispensing container. Again, while this may seem a simple step, in high volume production it is a significant and labor intensive one. Once more, the advantages of one type of container are achieved without sacrificing the advantages of the other.

While a full and complete description of the invention has been set forth in accordance with the dictates of the Patent Statutes, it should be understood that modifications can be resorted to without departing from the spirit hereof or the scope of the appended claims.

Thus, it should be noted that while the contents S have been described as soap, the invention has utility with a wide variety of contents.

Also, the invention is not intended to be limited to any particular material, such as plastic or to any particular configuration such as cylindrical.

What is claimed is:

1. A free-standing, multiple-use container, comprising:

(A) an elongate body;

(B) a removable lid receivable on one end of said body; and (C) an integral bottom panel normally closing off the opposed end of said body and including (1) a centrally disposed score line defining a relatively small removable access disc; and (2) a concentric score line spaced closely inwardly from the periphery of said bottom panel defining a dispensing member upon removal of said access disc whereby said container may be used as a dip can with said lid removed and said bottom panel intact and as a self-dispensing container with said bottom panel severed and said access disc removed for dispensing material through the opening thus formed upon pressure being applied to the bottom member when severed.

* * * * *